United States Patent [19]

Paton et al.

[11] 4,092,181

[45] May 30, 1978

[54] METHOD OF IMPARTING A FINE GRAIN STRUCTURE TO ALUMINUM ALLOYS HAVING PRECIPITATING CONSTITUENTS

[75] Inventors: Neil E. Paton; C. Howard Hamilton, both of Thousand Oaks, Calif.

[73] Assignee: Rockwell International Corporation, El Segundo, Calif.

[21] Appl. No.: 790,207

[22] Filed: Apr. 25, 1977

[51] Int. Cl.[2] ..... C22F 1/04

[52] U.S. Cl. ..... 148/12.7 A

[58] Field of Search ..... 148/12.7 A

[56] References Cited

U.S. PATENT DOCUMENTS

| | | | |
|---|---|---|---|
| 2,083,576 | 6/1937 | Nock, Jr. | 148/12.7 A |
| 3,706,606 | 12/1972 | DiRusso et al. | 148/12.7 A |
| 3,726,725 | 4/1973 | Gold | 148/12.7 A |
| 3,743,549 | 7/1973 | DiRusso et al. | 148/12.7 A |

*Primary Examiner*—W. Stallard

*Attorney, Agent, or Firm*—L. Lee Humphries; Craig O. Malin

[57] ABSTRACT

A method is provided for imparting a fine grain structure to aluminum alloys which have precipitating constituents. The alloy is first heated to a solid solution temperature to dissolve the precipitating constituents in the alloy. The alloy is then cooled, preferably by water quenching, to below the solution temperature and then overaged to form precipitates by heating it above the precipitation hardening temperature for the alloy, but below its solution treating temperature. Strain energy is introduced into the alloy by plastically deforming it at or below the overaging temperature used. The alloy is then subsequently held at a recrystallization temperature so that the new grains are nucleated by the overaged precipitates and the development of these grains results in a fine grain structure.

13 Claims, 2 Drawing Figures

METHOD OF IMPARTING A FINE GRAIN STRUCTURE TO ALUMINUM ALLOYS HAVING PRECIPITATING CONSTITUENTS

BACKGROUND OF THE INVENTION

A. Field of the Invention

This invention relates to the field of metallurgy, and particularly to the field of processing precipitation hardenable aluminum alloys.

B. Description of the Prior Art

A fine grain size tends to improve the mechanical properties of most structural materials. Additionally, formability can be improved by elimination of "orange peel" structure, and superplasticity realized in many alloys by providing a fine grain structure. For alloys which are susceptable to stress corrosion cracking such as many precipitation hardening aluminum alloys, a fine grain structure generally decreases the susceptibility to stress corrosion. However, grain refinement is difficult to achieve in aluminum alloys, and most attempts to obtain a fine grain size by conventional mechanical working and recrystallization by heating have only resulted in the material recrystallizing to the original coarse grain size with large "pancake" shaped grains.

Limited success for 7075 aluminum alloy has been reported recently in a paper by Waldman, Sulinski, and Marcus, "The Effect of Ingot Processing Treatment on the Grain Size and Properties of Al Alloy 7075", Metallurgical Transactions, Vol. 5, March, 1974, pp. 573–584. The reported treatment requires a long-time high-temperature homogenization to precipitate chrominum prior to slow cooling to precipitate Zn, Mg, and Cu. The 7075 aluminum alloy is then mechanically worked and recrystallized by heating to refine the grain size. This prior art method is very time consuming and is limited to alloys containing specific elements such as chromium. Additionally, the prior art method does not create as fine a grain size as does the method of the present invention.

SUMMARY OF THE INVENTION

It is an object of the invention to provide a method to refine the grain size of aluminum alloys containing precipitation hardening constituents.

It is an object of the invention to provide a method of refining the grain size of precipitation hardening aluminum alloys which is less time consuming than the prior art method.

It is an object of the invention to provide a method of refining the grain size of a wide variety of precipitation hardening aluminum alloys.

It is an object of the invention to improve the mechanical properties such as strength and fatigue resistance of precipitation hardening aluminum alloys by providing a method to refine the grain size.

It is an object of the invention to improve the resistance of precipitation hardening aluminum alloys to stress corrosion cracking by providing a method to refine the grain size.

It is an object of the invention to improve the formability of precipitation hardening aluminum alloys by providing a method of refining the grain size.

According to the invention, a method is provided for imparting a fine grain structure to aluminum alloys which have precipitating constituents. The alloy is first heated to a solid solution temperature to dissolve the precipitating constituents in the alloy. The alloy is then cooled, preferably by water quenching, to below the solution temperature and then overaged to form precipitates by heating it above the precipitation hardening temperature for the alloy but below its solution treating temperature. Strain energy is introduced into the alloy by plastically deforming it at or below the overaging temperature used. The alloy is then subsequently held at a recrystallization temperature so that new grains are nucleated by the overaged precipitates and the growth of these grains provides a fine grain structure.

These and other objects and features of the present invention will be apparent from the following detailed description, taken with reference to the accompanying figures.

DESCRIPTION OF THE PREFERRED EMBODIMENT

According to the invention, the alloy is first solution treated in the conventional way, as would be done prior to precipitation hardening. This places the material in a coarse-grained condition. Instead of being followed by the standard precipitation hardening treatment (a low temperature aging treatment to produce a fine distribution of precipitates spaced 100 to 500 A apart suitable for increasing the strength of the alloy), the material is subjected to a high temperature precipitation treatment, called overaging, which produces a somewhat coarser distribution of precipitates spaced ~5,000 to 10,000 A apart. Next, the material is mechanically worked (plastically deformed) a sufficient amount to provide the lattice strain necessary for recrystallization. It is desirable to work the material to achieve more than 40% reduction in thickness. However, this is not always possible, as in the case of forging some parts; and in this case a reduction of at least 15% will aid in reducing grain size even though optimum working is not achieved. Finally, the worked material is heated above the recrystallization temperature to induce recrystallization at which time new grains are nucleated on the precipitates formed during the previous overaging treatment. It also appears that these precipitates act to retard further grain growth.

Figure 1:
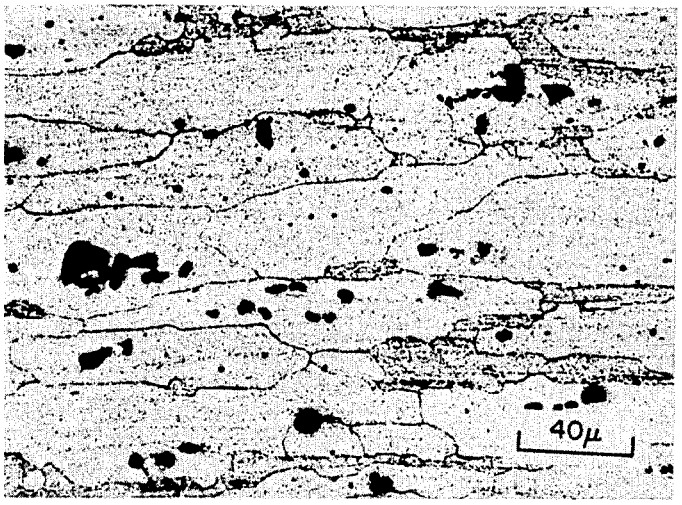
FIG. 1 is a photomicrograph of the microstructure of 7075 aluminum alloy showing the typical grain size available.
Figure 2:
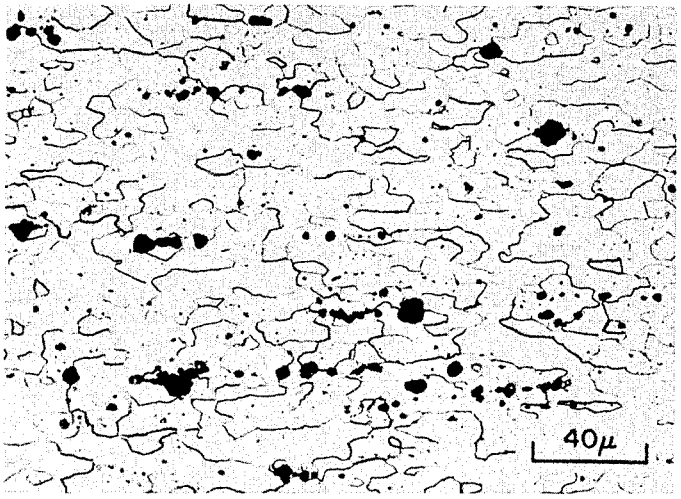
FIG. 2 is a photomicrograph of the microstructure of 7075 aluminum alloy showing the grain size available when the alloy is processed according to the present invention.

FIG. 2 shows a fine grained structure (grains approximately 10μm in size) produced by a sequence of treatments such as that described above. The decrease in grain size as compared to the grain size (over 100μm) in conventionally processed aluminum as shown in FIG. 1 is clearly evident in these photomicrographs. The resulting fine grain structure is stable, and can be subsequently heat treated according to conventional practice.

The invention comprises creating a suitable precipitate dispersion before mechanical working and recrystallization steps. If the precipitates are sufficiently large in size and spaced about 5,000 to 10,000 A apart, they act as nuclei for new grains and result in a fine, stable grain structure. Since such a dispersion of a precipitate can be introduced in any precipitation hardenable aluminum alloy, the process is suitable for application on all aluminum alloys which are precipitation hardenable.

The following examples are illustrative of the invention as applied to precipitate hardening alloys of different compositions.

EXAMPLE 1 Aluminum Alloy 7075

Alloy 7075 is a precipitation hardening aluminum base alloy containing (nominally) 5.5% Zn, 2.5% Mg, 1.5% Cu, and .3% Cr. It is solution treated at 860° F to 930° F for three hours and then water quenched to maintain the precipitate in solution. The normal precipitation hardening treatment for 7075 alloy is 240° F to 260° F for 23 to 28 hours and produces a fine precipitate spaced only 100 to 500 A apart. While this conventional precipitation hardening treatment produces good strength in the alloy, it does not produce a fine grain size. Therefore, rather than using the standard precipitation hardening treatment, the solution treated alloy is overaged 700° to 800° F (preferable at 750° F) for about 8 hours. This produces a somewhat coarse distribution of precipitates spaced approximately 5,000 to 10,000 A apart.

The overaged alloy is plastically deformed by mechanically working in order to strain the lattice sufficiently to permit recrystallization of the structure. For 7075 alloy, a 40% to 80% reduction in thickness by hot rolling at 400° to 500° F proved satisfactory. Finally, the worked material is heated at 860° F to 900° F for 1–4 hours to recrystallize a fine grained structure such as illustrated in FIG. 2. The result of this treatment is a stable, fine grained structure which can be subsequently heat treated according to standard practice.

EXAMPLE 2 Aluminum Alloy 2219

Alloy 2219 is a precipitate hardening aluminum base alloy containing (nominally) 6.3% Cu, 0.3% Mn, 0.06% Ti, and 0.10% V. It is solution heat treated at 985° F to 1005° F for at least 20 minutes and quenched in water. It can then be overaged at any temperature between 385° F and 985° F depending upon time at the aging temperature. A temperature of 750°–850° F for 8 hours is practical for most applications. The overaged alloy is plastically deformed at least 40% at a temperature less than the temperature at which it was overaged by warm rolling or forging and then recrystallized by holding at a temperature above the minimum recrystallization temperature but below the melting temperature, for example 935° F. The resulting fine grained structure can be solution treated and age hardened according to conventional practice.

EXAMPLE 3 Aluminum Alloy 2014

Alloy 2014 is a precipitate hardening aluminum base alloy containing (nominally) 4.4% Cu, 0.8% Si, 0.8% Mn, and 0.4% Mg. It is solution heat treated at 925° F to 945° F for at least 20 minutes and quenched in water at 212° F maximum. It can then be overaged at any temperature between 360° F and 925° F (600°–800° F preferred), the lower temperatures requiring much longer hold times. The overaged alloy is mechanically worked at least 40% reduction in thickness at a temperature equal to or less than the temperature at which it was overaged and recrystallized by holding at a temperature above the minimum recrystallization temperature but at or below the maximum solution temperature, for example 800° F. If the material is quenched in water from this temperature, the resulting fine grained, solution annealed structure can be precipitation hardened at its normal age hardening temperature.

EXAMPLE 4 Aluminum Alloy 6061

Alloy 6061 is a precipitate hardening aluminum base alloy containing (nominally) 1.0% Mg, 0.6% Si, 0.25% Cu, and 0.25% Cr. It is solution heat treated at 970° F to 1000° F followed by water quenching. It can then be overaged by heating at a temperature between 600°–850° F, for example 650° F for 8 hours. The overaged alloy is mechanically worked at a temperature of 650° F or less (for example) a sufficient amount to provide the lattice strain necessary for recrystallization. The deformed material is recrystallized above the minimum recrystallization temperature but below the melting temperature, for example 900° F. The resulting material has a stable, fine grained structure which can be subsequently heat treated according to conventional techniques.

From the above examples, one skilled in the art can readily develop appropriate heat treatment and plastic deformation schedules for any precipitation hardening aluminum alloy based upon standard solution treating and precipitation hardening treatment. Table 1 below, abstracted from "Metals Handbook", vol. 2, 8th edition, p. 272, American Society for Metals, gives these standard treatments for many aluminum alloys, except for alloys 7049 and 7050 for which estimated values are given.

The term precipitation hardening refers to precipitates developed at times and temperatures which give the alloy optimum strength properties, such as shown in Table I. The term overaging refers to precipitates developed at longer times and/or higher temperatures than used for precipitation hardening.

The relation between time and temperature for age hardening aluminum alloys is also well known in the art. For example, low aging temperatures require longer hold times to accomplish equivalent amounts of aging as can be accomplished at high aging temperatures for shorter hold times. Likewise, the hold time for solution treatment is a function of the hold temperature, although within a narrower temperature range.

It is also known to the artisan that the recrystallization temperature is related to the amount of plastic strain (mechanical work or cold work) introduced into the lattice. For severely worked aluminum alloys, the minimum recrystallization temperature is over 600° F. Likewise, the amount of mechanical work of the alloy required to permit recrystallization varies depending upon factors such as the recrystallization temperature and the time at the recrystallization temperature. For most practical applications, the amount of mechanical work, as measured by reduction in thickness, should be over 15%.

Table 1.

STANDARD HEAT TREATMENT RANGES OF WROUGHT ALUMINUM ALLOYS

| Alloy | Solution Temperature (F) | Precipitation Hardening Treatment Time (hr) | Precipitation Hardening Treatment Temperature (F) |
|---|---|---|---|
| 2014 | 925 to 945 | 9 to 19 | 310 to 350 |
| 2018 | 940 to 960 | 5 to 11 | 330 to 460 |
| 2020 | 950 to 970 | 17 to 19 | 310 to 330 |
| 2024 | 910 to 930 | 17 to 18 | 370 to 380 |
| 2218 | 940 to 960 | 5 to 11 | 330 to 460 |
| 2219 | 985 to 1005 | 9 to 19 | 340 to 385 |
| 2618 | 970 to 990 | 19 to 21 | 385 to 395 |
| 4032 | 940 to 970 | 9 to 11 | 330 to 350 |
| 6053 | 960 to 985 | 7 to 19 | 310 to 360 |
| 6061 | 970 to 1000 | 7 to 19 | 310 to 360 |

Table 1.-continued

STANDARD HEAT TREATMENT RANGES OF WROUGHT ALUMINUM ALLOYS

| Alloy | Solution Temperature (F) | Precipitation Hardening Treatment Time (hr) | Temperature (F) |
|---|---|---|---|
| 6062 | 970 to 1000 | 7 to 19 | 310 to 360 |
| 6063 | 970 to 1000 | 7 to 19 | 310 to 360 |
| 6066 | 970 to 1000 | 7 to 19 | 310 to 360 |
| 6151 | 960 to 980 | 9 to 19 | 310 to 350 |
| 7049 | 860 to 930 | 23 to 28 | 240 to 260 |
| 7050 | 860 to 930 | 23 to 28 | 240 to 260 |
| 7075 | 860 to 930 | 23 to 28 | 240 to 260 |
| 7076 | 860 to 880 | 13 to 15 | 270 to 280 |
| 7079 | 820 to 880 | 5 days + | room temperature |
| | | 48–50 hrs. | 230 to 250 |
| | or | 6–10 days + | 190 to 200 |
| | | 23–28 hrs. | 240 to 260 |
| 7178 | 860 to 880 | 23 to 28 | 240 to 260 |

Material which has been previously solution treated by the supplier can be directly overaged without repeating the solution treatment. Also, material which has been solution treated and then given a precipitation hardening treatment can be directly overaged without requiring an additional solution treatment to redissolve the fine distribution of precipitates.

Although present tests indicate that solution treatment followed by rapid cooling to approximately room temperature provides a suitable condition for overaging the alloy, a less rapid cool, or a cool directly to the overaging temperature is satisfactory for some applications.

Numerous variations and modifications may be made without departing from the present invention. Accordingly, it should be clearly understood that the form of the present invention described above and shown in the accompanying drawings is illustrative only and is not intended to limit the scope of the present invention.

What is claimed is:

1. A method of imparting a fine grain structure to an aluminum alloy having a precipitating constituent, comprising:
   - providing an aluminum alloy having a precipitating constituent;
   - heating said alloy to a solid solution temperature to dissolve at least some of said precipitating constituent in said alloy;
   - cooling said alloy to a temperature below said solution temperature;
   - heating said alloy to an overaging temperature above the precipitation hardening temperature for said alloy but below said solution treating temperature to overage said alloy;
   - plastically deforming said alloy at a temperature equal to or below said overaging temperature a sufficient amount to provide lattice strain for recrystallization; and
   - heating said alloy to a recrystallization temperature, whereby precipitates formed during said step of heating to overage said alloy form nuclei for the recrystallization and controlled growth of a fine grain structure.

2. The method as claimed in claim 1, including the step of precipitation hardening said alloy after said cooling step and prior to said step of heating said alloy to overage said alloy.

3. The method as claimed in claim 1, wherein:
   - said solution temperature is in the range of 820° F to 1005° F;
   - said overaging temperature is in the range of 260° F to 985° F; and
   - said recrystallization temperature is in the range of 600° F to 1005° F.

4. The method as claimed in claim 1, wherein said cooling step comprises rapidly cooling said alloy to room temperature.

5. The method as claimed in claim 1, wherein said cooling step comprises water quenching said alloy in water at a temperature of 212° F maximum.

6. The method as claimed in claim 1, wherein said step of plastic deforming comprises plastic deforming said alloy a minimum of 15% of its thickness.

7. A method of imparting a fine grain structure to an aluminum alloy having a precipitating constituent, comprising:
   - providing an aluminum alloy having a precipitating constituent;
   - heating said alloy to a temperature in the range of 820° F to 1005° F to dissolve said precipitating constituents in said alloy;
   - cooling said alloy to a temperature below about 212° F;
   - heating said alloy to an overaging temperature in the range of 260° F to 985° F to overage said alloy;
   - plastically deforming said alloy a minimum of 15% of its thickness at a temperature equal to or below said overaging temperature; and
   - heating said alloy to a temperature in the range of 600° F to 1005° F, whereby precipitates formed during said step of heating to overage said alloy forms nuclei for the recrystallization and controlled growth of a fine grain structure.

8. A method of imparting a fine grain structure to an aluminum alloy selected from the group consisting of aluminum alloy numbers 2014, 2018, 2020, 2024, and 4032, comprising:
   - providing an aluminum alloy from said group;
   - heating said alloy to a temperature in the range of 910° F to 960° F to dissolve the precipitating constituents in said alloy;
   - cooling said alloy to a temperature below said solution temperature;
   - heating said alloy to an overaging temperature in the range of 330° F to 910° F to overage said alloy;
   - plastically deforming said alloy a minimum of about 40% of its thickness at a temperature equal to or below said overaging temperature to introduce strain energy into said alloy; and
   - heating said alloy to a temperature in the range of 600° F to 970° F, whereby precipitates formed during said step of heaing to overage said alloy forms nuclei for the recrystallization and controlled growth of a fine grain structure.

9. A method of imparting a fine grain structure to an aluminum alloy selected from the group consisting of aluminum alloy numbers 2219, 6053, 6061, 6062, 6063, 6066, and 6151, comprising:
   - providing an aluminum alloy from said group;
   - heating said alloy to a temperature in the range of 960° F to 1005° F to dissolve the precipitating constituents in said alloy;
   - cooling said alloy to a temperature below said solution temperature;
   - heating said alloy to an overaging temperature in the range of 350° F to 960° F to overage said alloy;
   - plastically deforming said alloy a minimum of about 40% of its thickness at a temperature equal to or below said overaging temperature to introduce strain energy into said alloy; and heating said alloy to a temperature in the range of 600° F to 1005° F, whereby precipitates formed during said step of heating to overage said alloy forms nuclei for the recrystallization and controlled growth of a fine grain structure.

10. A method of imparting a fine grain structure to an aluminum alloy selected from the group consisting of aluminum alloy numbers 7049, 7050, 7075, 7076, 7079, and 7178, comprising:

providing an aluminum alloy from said group;

heating said alloy to a temperature in the range of 820° F to 930° F to dissolve the precipitating constituents in said alloy;

cooling said alloy to a temperature below said solution temperature;

heating said alloy to an overaging temperature in the range of 280° F to 820° F to overage said alloy;

plastically deforming said alloy a minimum of about 40% of its thickness at a temperature equal to or below said overaging temperature to introduce strain energy into said alloy; and heating said alloy to a temperature in the range of 600° F to 930° F, whereby precipitates formed during said step of heating to overage said alloy forms nuclei for the recrystallization and controlled growth of a fine grain structure.

11. A method of imparting a fine grain structure to an aluminum alloy having a precipitating constituent, comprising:

providing an aluminum alloy having a precipitating constituent;

dissolving at least some of said precipitating constitutent in said alloy by heating said alloy to a solid solution temperature;

cooling said alloy to a temperature below said solid solution temperature;

overaging said alloy to form precipitates;

plastically straining said alloy; and recrystallizing said alloy by heating it above the minimum recrystallization temperature, whereby said precipitates form nuclei for the recrystallization and controlled growth of a fine grain structure.

12. The method as claimed in claim 11, wherein said precipitates are spaced predominately 5,000 to 10,000 A apart.

13. The method as claimed in claim 11, wherein said cooling step comprises cooling said alloy directly to an overaging temperature.

* * * * *

REEXAMINATION CERTIFICATE (294th)

United States Patent [19]

Paton et al.

[11] B1 4,092,181

[45] Certificate Issued Jan. 1, 1985

[54] METHOD OF IMPARTING A FINE GRAIN STRUCTURE TO ALUMINUM ALLOYS HAVING PRECIPITATING CONSTITUENTS

[75] Inventors: Neil E. Paton; C. Howard Hamilton, both of Thousand Oaks, Calif.

[73] Assignee: Rockwell International Corporation, El Segundo, Calif.

Reexamination Request:

No. 90/000,494, Jan. 30, 1984

Reexamination Certificate for:

| | |
|---|---|
| Patent No.: | **4,092,181** |
| Issued: | **May 30, 1978** |
| Appl. No.: | **790,207** |
| Filed: | **Apr. 25, 1977** |

[51] Int. Cl.[3] ..... C22F 1/04
[52] U.S. Cl. ..... 148/12.7 A
[58] Field of Search ..... 148/11.5 A, 12.7 A

[56] References Cited

U.S. PATENT DOCUMENTS 3,847,681 11/1974 Waldman et al. ..... 148/11.5 A

*Primary Examiner*—W. Stallard

[57] ABSTRACT

A method is provided for imparting a fine grain structure to aluminum alloys which have precipitating constituents. The alloy is first heated to a solid solution temperature to dissolve the precipitating constituents in the alloy. The alloy is then cooled, preferably by water quenching, to below the solution temperature and then overaged to form precipitates by heating it above the precipitation hardening temperature for the alloy but below its solution treating temperature. Strain energy is introduced into the alloy by plastically deforming it at or below the overaging temperature used. The alloy is then subsequently held at a recrystallization temperature so that the new grains are nucleated by the overaged precipitates and the development of these grains results in a fine grain structure.

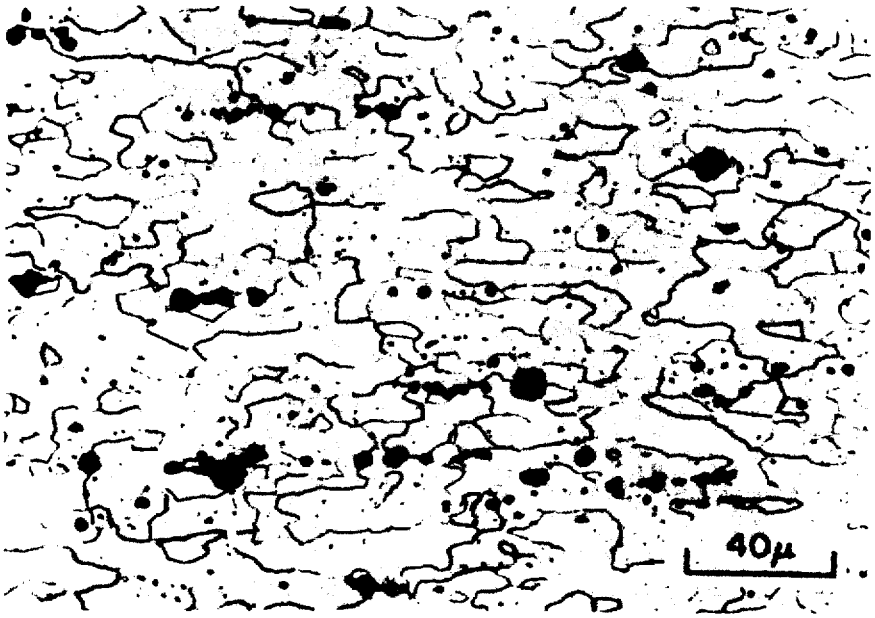

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 7–9 and 11–13 is confirmed.

Claims 1 and 10 are determined to be patentable as amended.

Claims 2–6, dependent on an amended claim, are determined to be patentable.

New claims 14–20 are added and determined to be patentable.

1. A method of imparting a fine grain structure to an aluminum alloy having a precipitating constituent, comprising:

providing an aluminum alloy having a precipitating constituent;

heating said alloy to a solid solution temperature to dissolve at least some of said precipitating constituent in said alloy;

cooling said alloy to a temperature below said solution temperature;

heating said alloy to an overaging temperature above the precipitation hardening temperature for said alloy but below said solution treating temperature to overage said alloy;

plastically deforming said alloy at a temperature equal to or below said overaging temperature a sufficient amount to provide lattice strain for recrystallization; and heating said alloy to a recrystallization temperature *and holding at said recrystallization temperature for about 1–4 hours*, whereby precipitates formed during said step of heating to overage said alloy form nuclei for the recrystallization and controlled growth of a fine grain structure *without using a high temperature plastic deformation or homogenization step after said step of heating to a recrystallization temperature.*

10. A method of imparting a fine grain structure to an aluminum alloy selected from the group consisting of aluminum alloy numbers 7049, 7050, 7075, 7076, 7079, and 7178, comprising:

providing an aluminum alloy from said group;

heating said alloy to a *solution* temperature in the range of 820° F. to 930° F. to dissolve the precipitating constituents in said alloy;

cooling said alloy to a temperature below said solution temperature;

heating said alloy to an overaging temperature in the range of 280° F. to 820° F. to overage said alloy;

plastically deforming said alloy a minimum of about 40% of its thickness at a temperature equal to or below said overaging temperature to introduce strain energy into said alloy; and heating said alloy to a temperature in the range of 600° F. to 930° F., whereby precipitates formed during said step of heating to overage said alloy forms nuclei for the recrystallization and controlled growth of a fine grain structure *without using a high temperature plastic deformation or homogenization step after said step of heating for recrystallization.*

*14. A method of imparting a fine grain structure to an aluminum alloy having a precipitating constituent, comprising:*

*providing an aluminum alloy having a precipitating constituent;*

*heating said alloy to a solid solution temperature to dissolve at least some of said precipitating constituent in said alloy;*

*rapidly cooling said alloy to a temperature below said solution temperature;*

*reheating said alloy to an overaging temperature above the precipitation hardening temperature for said alloy but below said solution treating temperature to overage said alloy;*

*plastically deforming said alloy at a temperature equal to or below said overaging temperature a sufficient amount to provide lattice strain for recrystallization; and*

*heating said alloy to a recrystallization temperature, whereby precipitates formed during said step of heating to overage said alloy form nuclei for the recrystallization and controlled growth of a fine grain structure.*

*15. The method as claimed in claim 14, including the step of precipitation hardening said alloy after said cooling step and prior to said step of reheating said alloy to overage said alloy.*

*16. The method as claimed in claim 14, wherein:*

*said solution temperature is in the range of 820° F. to 1005° F.; and*

*said overaging temperature is in the range of 260° F. to 985° F.*

*17. The method as claimed in claim 14, wherein said rapidly cooling step comprises water quenching said alloy in water at a temperature of 212° F. maximum.*

*18. The method as claimed in claim 14, wherein said step of plastic deforming comprises plastic deforming said alloy a minimum of 15% of its thickness.*

*19. A method of imparting a fine grain structure to an aluminum alloy selected from the group consisting of aluminum alloy numbers 7049, 7050, 7075, 7076, 7079, and 7178, comprising:*

*providing an aluminum alloy from said group;*

*heating said alloy to a temperature in the range of 820° F. to 930° F. to dissolve the precipitating constituents in said alloy;*

*cooling said alloy to approximately room temperature;*

*heating said alloy to above said approximately room temperature to an overaging temperature in the range of 280° F. to 820° F. to overage said alloy;*

*plastically deforming said alloy a minimum of about 40% of its thickness at a temperature equal to or below said overaging temperature to introduce strain energy into said alloy; and*

*heating said alloy to a temperature in the range of 600° F. to 930° F., whereby precipitates formed during said step of heating to overage said alloy forms nuclei for*

*the recrystallization and controlled growth of a fine grain structure.*

*20. A method of imparting a fine grain structure to an aluminum alloy selected from the group consisting of aluminum alloy numbers 7049, 7050, 7075, 7076, 7079, and 7178, comprising:*

*providing an aluminum alloy from said group;*

*heating said alloy to a solution temperature in the range of 820° to 930° F. to dissolve the precipitating constituents in said alloy;*

*cooling said alloy to a temperature below said solution temperature;*

*heating said alloy to an overaging temperature in the range of 280° F. to 820° F. to overage said alloy;*

*plastically deforming said alloy a minimum of about 40% of its thickness at a temperature equal to or below said overaging temperature to introduce strain energy into said alloy; and*

*heating said alloy to a temperature in the range of 600° F. to 930° F. and holding in said range of 600° F. to 930° F. for no more than 4 hours, whereby precipitates formed during said step of heating to overage said alloy forms nuclei for the recrystallization and controlled growth of a fine grain structure without using a high temperature plastic deformation or homogenization step after said step of heating for recrystallization.*

* * * * *